United States Patent [19]

Lipes

[11] 3,946,538

[45] Mar. 30, 1976

[54] BAG HOLDING DEVICE

[76] Inventor: Arnold Lipes, 521 Merton Road, Cote St. Luc, Montreal, Quebec, Canada

[22] Filed: June 27, 1975

[21] Appl. No.: 591,081

Related U.S. Application Data

[63] Continuation of Ser. No. 422,364, Dec. 6, 1973, abandoned.

[52] U.S. Cl. ..... 53/189; 53/385

[51] Int. Cl.[2] ..... B65B 43/36

[58] Field of Search ..... 53/29, 188, 189, 190, 249, 53/266, 285, 371–373, 384–386

[56] References Cited

UNITED STATES PATENTS

| | | | |
|---|---|---|---|
| 3,731,454 | 5/1973 | Crabb | 53/190 X |
| 3,822,527 | 7/1974 | Germunson et al. | 53/189 |
| 3,842,569 | 10/1974 | McClelland et al. | 53/188 X |

*Primary Examiner*—Robert L. Spruill

[57] ABSTRACT

A bag holding device and method for holding bags of the type having an extended tab secured to a bag sidewall and extending above a mouth opening. The bag holding device comprises bag opening means for opening the mouth of the first bag from a plurality of aligned bags. Actuable holding means are further provided engaging a portion of the tab of the first bag. Means are also provided for displacing the first bag from the plurality of bags.

9 Claims, 4 Drawing Figures

BAG HOLDING DEVICE

This is a continuation of application Ser. No. 422,364, Dec. 6, 1973 and now abandoned.

BACKGROUND OF INVENTION

1. Field of the Invention

The present invention relates to a bag holding device for holding and transferring bags of the types having an extended tab secured to a bag sidewall and extending above a mouth opening.

2. Description of the Prior Art

More particularly, but not exclusively, the bag holding device of the present invention is particularly useful for holding a plastic bag at a filling station and transferring this bag to a sealing station where a seal is made below the mouth of the bag while the contents are in the bag. Thus, when the bag is released the contents are already sealed in the bag and then conveyed for shipping.

In the prior art, and for example as disclosed in U.S. Pat. No. 3,698,153 issued Oct. 17, 1972 and also U.S. Pat. No. 3,468,100 issued Sept. 23, 1969, each bag is filled with its contents and then released onto a conveyor or slide for transportation to a sealing station. A disadvantage of this type of apparatus is that the bag is torn from its holding pins by the weight of the contents released therein and the top portion of the bag is no longer held. Therefore, there is no positive means of ensuring positive control of the bag for further handling either at another filling station or bag closing station, etc. In other known methods, additional means are used to pull or push the bag and its contents in a direction away from the holding pins to cause the extended lip of the bag to tear away from the holding pins. However, in these methods the bags are also released and the same disadvantages occur. With these known methods it is also possible that the contents may fall out of the bag during conveyance or be displaced from its required orientation, and therefore often there is required additional inspection.

A further disadvantage of the prior art is that the bag and its contents must be handled again by an operator or machine for sealing. Because there are contents inside the bag, it is very difficult to ensure uniform facial contact between both sidewalls of the bag below (the mouth as often there are folds in one or both sidewalls of the bag and this may result in an imperfect seal, often resulting in leaks at the seal as well as permanent wrinkles and making the bag essentially poor. Also, unless the top of the bag is held positively, it is very difficult to ensure that the contents of the bag are not in interference with the sealing area near the mouth of the bag.

It is a feature of the present invention to provide a bag holding device which substantially overcomes the above-mentioned disadvantages.

It is a further feature of the present invention to provide a bag holding device which will hold the bag during its filling and also transfer the bag to a sealing station.

It is a still further feature of the present invention to provide a holding device which will align the sealing portion of both sidewalls of the bag in facial contact prior to sealing whereby to provide a seal which is substantially uniform and leak-proof.

According to the above features, from a broad aspect, the present invention provides a bag holding device and method for holding bags of the type having an extended tab secured to a bag sidewall and extending above a mouth opening. The bag holding device comprises bag opening means for opening the mouth of the first bag from a plurality of aligned bags. Actuable holding means are further provided engaging a portion of the tab of the first bag. Means are also provided for displacing the first bag from the plurality of bags.

BRIEF DESCRIPTION OF DRAWINGS

A preferred embodiment of the present invention will now be described with reference to the accompanying drawings in which.

DESCRIPTION OF PREFERRED EMBODIMENTS

Figure 1:
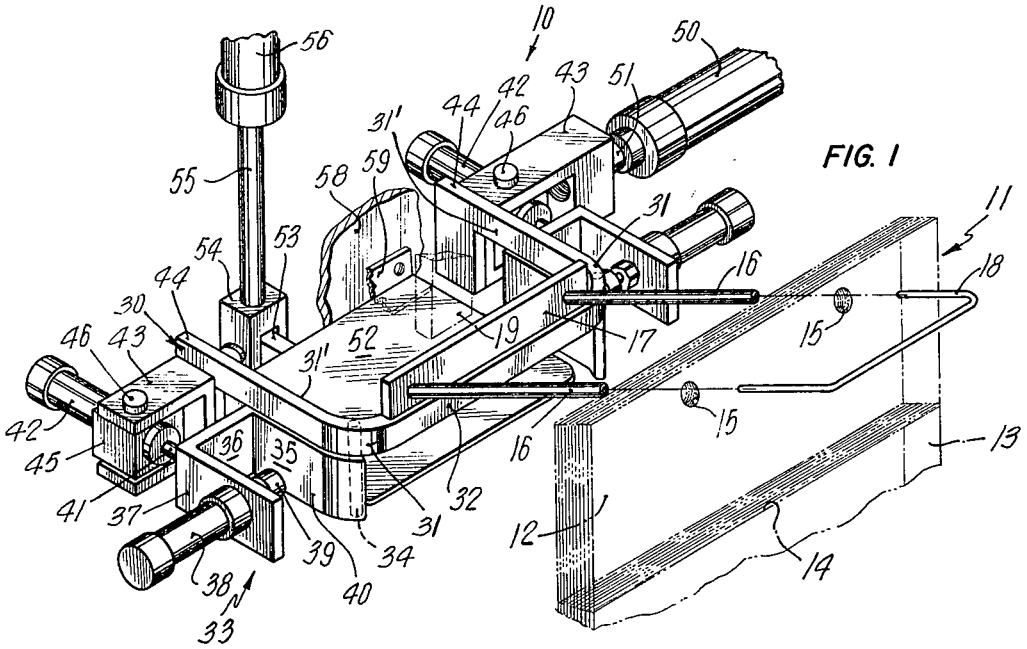
FIG. 1 is a perspective view of the bag holding device showing its relationship to a plurality of bags facially aligned on two holding pins.

Referring now to the drawings, there is shown generally at 10 the bag holding device of the present invention. The holding device 10 is adapted for use with bags such as shown at 11 wherein a tab 12 is secured to a bag sidewall 13 extending above a mouth opening 14. The extended tab 12 is provided with two holes 15 therein and adapted to slide over a respective one of a pair of holding pins 16 secured in spaced parallel relationship from an end abutment wall 17. The holding pins 16 extend angularly upwards from the abutment wall 17 whereby the bags 11 will slide on the holding pins 16 towards the abutment wall 17 to ensure that the first bag is always against the abutment wall. A disconnectable U-shaped rod 18 permits the insertion of the bags onto the holding pin 16. If required, a pusher element not shown may be positioned behind the bags to ensure movement of the bags towards the abutment wall 7.

The bags 11 are usually supported on the holding pins or any other suitable holding means at a bag loading station. These bags are also usually made of plastic material.

An air duct 19, shown in phantom lines, is positioned adjacent the abutment wall 17 or other convenient location and directs an air stream into the area of the mouth opening 14 of the first bag of a plurality of bags secured on the holding pins. This causes the mouth opening 14 of the first bag to open to permit insertion of its contents therein.

The holding device 10 comprises a connecting frame 30 which is of generally U-shaped configuration defining sidewalls 31' and front wall 32. The corner portion 33 of the connecting frame 30, at the junction of the sidewalls 31' and the front wall 32 is arcuately formed whereby to present a smooth arcuate surface for the tab 12 of the bag which is to be positioned thereover. A hinged pin 34 is secured in this corner portion 31 and extends thereunder to connect to an actuable holding means 33. The actuable holding means 33 extends partially below its respective sidewall 31'. Both actuable holding means 33 are identical and for convenience only one will be described.

The actuable holding means 33 comprises a displaceable clamp plate 35 which is secured to the hinge 34. The clamp plate 35 is normally retained in alignment with the sidewall 31' and extends under the sidewall 31 from the corner portion 31 of the frame 30 to substantially midway along the sidewall 31'. A transverse connecting wall 36 is formed integrally with the clamp plate 35 and connects to an outer wall 37 located substantially parallel to the clamp plate 35. A clamping cylinder 38 is supported within the outer wall 37 and is provided with a clamping head 39 at the free end of its cylinder rod (not shown). By actuating the cylinder 38 the head 39 is caused to move towards and away from the clamp plate inner wall surface 40.

The connecting wall 36 of each holding means 33 is connected to a clamp actuating cylinder rod 41 of the clamp actuating cylinder 42. Cylinder 42 is rotatably secured to a U-shaped clamp 43 connected to the free end 44 of the connecting frame 30. The rotatable connection is provided by a pivotable block 45 secured between the U-shaped bracket 43 by means of vertically aligned pins 46. The operation of the clamp actuating cylinder 42 will be described later.

The bag holding device 10 is displaceable in the lateral plane by a displacing cylinder 50 having a cylinder rod 51 secured to one of the U-shaped brackets 43. By actuating the cylinder 50 the entire connecting frame and attached parts can be displaced sideways away from the abutment wall 17 or loading station. Of course, the displacing cylinder 50 can be secured otherwise if a different movement of the holding device is required. For example, the holding device may be displaced on an arc or else may be displaced rearwardly, that is to say, frontwards and away from the abutment wall 17.

Figure 2:
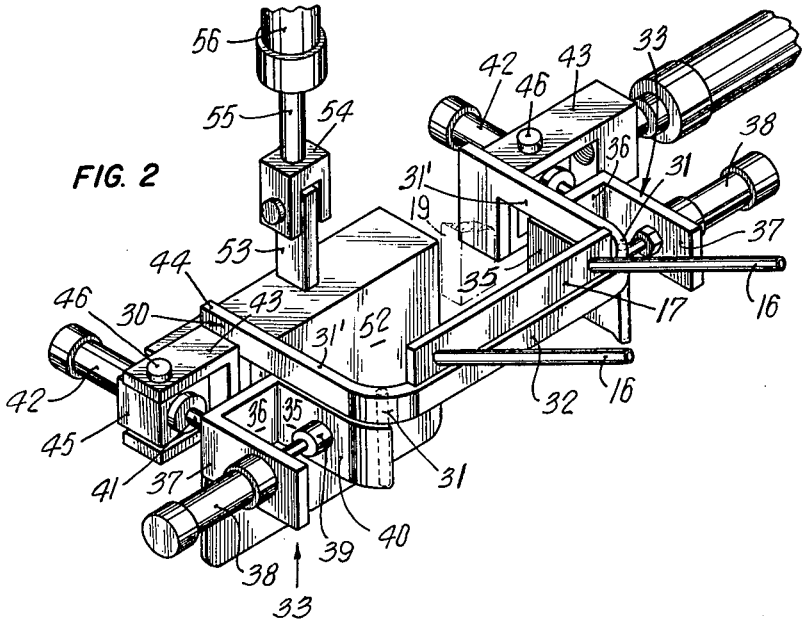
FIG. 2 is a perspective view of the holding device showing the hinged plate in its bag opening position.

Bag engagement means, in the form of a hinge plate 52 is provided for engaging a portion of the inner surface of the bag front wall and causing the side edge portions of the tab 12 of the bag to move between a respective one of the clamp plate wall 40 and their respective clamping head 39. The hinge plate 52 is provided with a connecting bar 53 which is pivotably connected to a connecting block secured to the free end of a cylinder rod 55 of actuating cylinder 56. The end edge of the hinge plate 52 is secured to a fixed wall 58 by means of a hinge 59 whereby the hinge plate 52 may be displaced, on its hinge 59, from a horizontal position, as shown in FIG. 1, to a downwardly vertical position, as shown in FIG. 2. In FIG. 2, the hinge plate is shown in its downward vertical position where the plate engages within the mouth opening 14 of the first bag which is in contact with the abutment wall 17. The plate 52 will draw the front wall of the bag outwardly causing the end portions of the extended tab 12 to be inserted within the holding means 33, as discussed above. The clamping cylinders 38 are then actuated to rigidly secure end portions of the tab 12 against the inner wall surfaces 40. The contents are then placed within the bag which is firmly held by the holding device 10.

Figure 3:
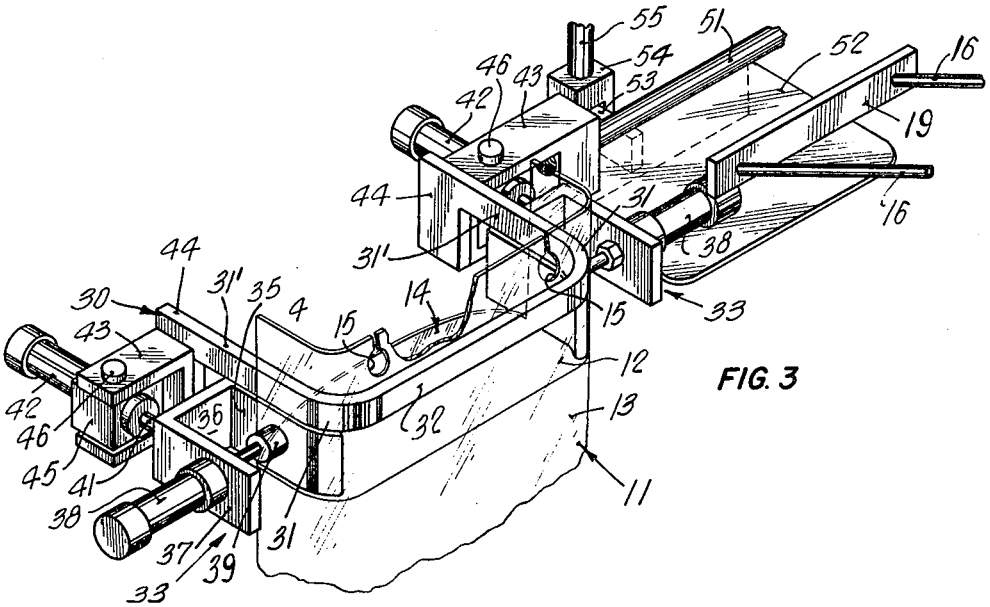
FIG. 3 is a perspective view of the holding device showing the device in its transferred position.
Figure 4:
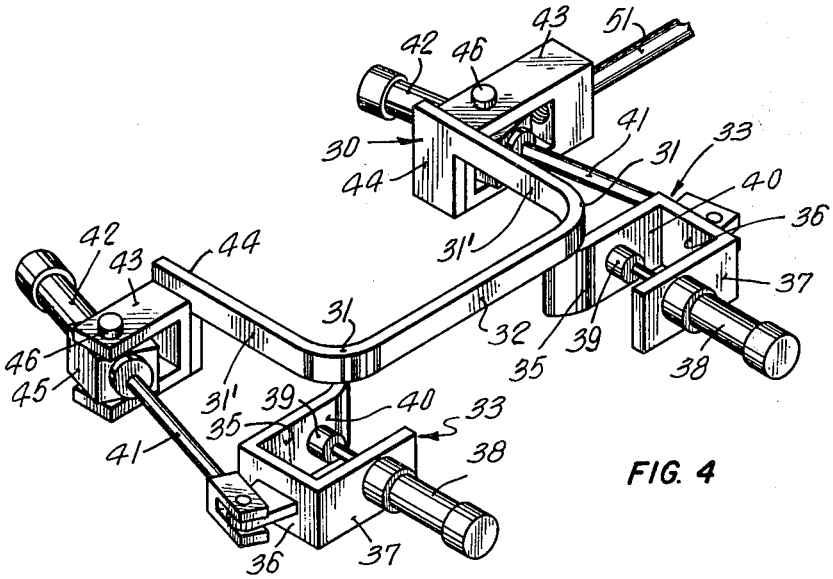
FIG. 4 is a perspective view of the holding device showing the position of the clamp plates when the bag sidewalls are being aligned prior to sealing.

After the contents are in the bag, the hinge plate is retracted to its horizontal position by cylinder 56. The displacing cylinder 50 is then actuated to move the connecting frame 30 and its assembly to a bag sealing station (not shown), see FIG. 3. At or on its way to the bag sealing station, the clamp actuating cylinders 42 are actuated causing the actuable holding means to pivot about the pin 34 displacing the clamp plates 35 outwardly of the frame sidewalls 31' through an arc of approximately 90 degrees. In this position, the hinged wall 40 is substantially aligned with the front wall 32 of the connecting frame 30, i.e. transverse to the sidewalls 31'. In this way, the top sealable portion of both bag sidewalls are aligned and substantially in facial contact and without wrinkles so that sealing bars (not shown) located on each side of the bag can be pressed against both sidewalls of the bag and not encounter any wrinkles or folds. As mentioned previously, sealing a bag with wrinkles or folds along the seal line may result in leaking for the reason that it is very difficult to seal two different thicknesses of material and still retain a leakproof seal. The bag holding device 10 holds on to the bag 11 while the sealing bars come together in alignment and only releases the bag after the sealing bars have applied pressure to the bag and retracted.

In the present embodiment the bags are made of plastic material and the sealing bars will melt the material to cause a seal of approximately ⅛ in. to ¼ in. in width thereacross. Above the sealing bars there is provided a cutoff wire (not shown) which will sever the extended lip portion of the bag extended above the bag content area. The bag will then fall onto an output conveyor and the extended lip portion 12 is blown away at the time the clamping cylinder 38 releases the extended lip portion of the bag. There are other possible means of removing the extended lip portion from the holding means 33 such as releasing it only during the movement of the device back to its initial position in front of the bags.

Thus it can be seen that with the bag holding device of the present invention there is overcome the problem of conveying bags to a sealing station after their contents have been inserted therein. Also, the problems of maintaining the sidewalls of the bag in substantially facial alignment to prevent folding and wrinkling is overcome. Accordingly a substantially perfect leakproof seal is obtained.

I claim:

1. A bag holding device for holding bags of the type having an extended tab secured to a bag sidewall and extending above a mouth opening, said holding device comprising bag opening means for opening said mouth of a first bag from a plurality of facially aligned bags, actuable holding means for engaging on either side thereof a portion of said extended tab of said first bag above said mouth opening, said actuable holding means having clamping means including two pairs of clamping surfaces, means for actuating said clamping surfaces to rigidly engage therebetween a portion of said tab adjacent opposed side edges of said tab prior to displacement of said first bag from said plurality of facially aligned bags, and means for displacing said first bag from said plurality of bags while maintaining a clamped relationship between said clamping surfaces and said tab.

2. A bag holding device as claimed in claim 1 wherein clamping means is displaceable for aligning a portion of opposed side walls of said first bag, and adjacent said mouth opening, prior to sealing said mouth opening.

3. A bag holding device as claimed in claim 1 wherein said pairs of clamping surfaces are constituted by two clamps each having a hinged wall pivotally connected to a connecting frame and positioned adjacent a respective one of the end edges of said extended tab of said bag, said tab being engaged adjacent their side edge between a clamping surface of a respective one of said hinged walls and a clamping surface of an associated actuable clamping head.

4. A bag holding device as claimed in claim 3 wherein said means for displacing said first bag from said plurality of facially aligned bags comprises a cylinder having a cylinder rod secured to said connecting frame and actuable to cause displacement of said frame and of said actuable holding means.

5. A bag holding device as claimed in claim 4 wherein said bags are retained in facial alignment on two spaced-apart parallel pins extending through said tabs, an abutment wall connected transversely across the ends of said pins to receive said first bag in abutment therewith, said bags being in their flat state and facially aligned with said mouth opening of each bag facing said abutment wall, said bags each defining a front wall below said mouth opening also facing said abutment wall, said bag opening means being positioned above and adjacent said abutment wall, said hinged wall of said two clamps being positioned below said abutment wall.

6. A bag holding device as claimed in claim 5 wherein said bag opening means comprises an air duct positioned to direct an air stream in the area of said mouth opening of said first bag to cause forward movement of said bag front wall relative to said tab, and bag engagement means insertable with said mouth opening of said first bag and engaging said bag front wall and causing the end portions of said tab to move between a respective one of said hinged wall of said clamps and their respective clamping head.

7. A bag holding means as claimed in claim 6 wherein said bag engagement means is a hinged plate pivotably connected for downward displacement between a horizontal and vertical plane, said horizontal plate lying below said connecting frame and actuable holding means.

8. A bag holding device as claimed in claim 3 wherein said hinged wall is of substantially U-shaped configuration defining a hinged wall pivotally secured to said frame, a connecting wall and an outer wall, a clamping cylinder connected to said outer wall and having a cylinder rod connnected to said clamping head, a clamp actuating cylinder rotatably secured to said connecting frame and having a cylinder rod connected to said connecting wall for displacing a respective one of said two clamps about said pivotal connection of said hinged wall and said frame.

9. A bag holding device as claimed in claim 3 wherein said bags are formed of plastic material, said material being held in alignment in a predetermined area below said mouth opening of said first bag by displacement of said hinged wall whereby opposed walls of said bags are free of folds prior to sealing said first bag.

* * * * *